US008275609B2

(12) United States Patent
Wang

(10) Patent No.: US 8,275,609 B2
(45) Date of Patent: Sep. 25, 2012

(54) VOICE ACTIVITY DETECTION

(75) Inventor: Zhe Wang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 364 days.

(21) Appl. No.: 12/630,963

(22) Filed: Dec. 4, 2009

(65) Prior Publication Data

US 2010/0088094 A1 Apr. 8, 2010

Related U.S. Application Data

(63) Continuation of application No. PCT/CN2008/070899, filed on May 7, 2008.

(30) Foreign Application Priority Data

Jun. 7, 2007 (CN) ..... 2007 1 0108408

(51) Int. Cl.
*G10L 11/06* (2006.01)

(52) U.S. Cl. ..... 704/214

(58) Field of Classification Search ..... 704/214, 704/215, 253
See application file for complete search history.

(56) References Cited

U.S. PATENT DOCUMENTS

| | | | | |
|---|---|---|---|---|
| 6,216,103 | B1 | 4/2001 | Wu et al. | |
| 6,324,509 | B1 | 11/2001 | Bi et al. | |
| 6,453,291 | B1 | 9/2002 | Ashley | |
| 6,480,823 | B1 | 11/2002 | Zhao et al. | |
| 7,653,537 | B2 * | 1/2010 | Padhi et al. | 704/218 |
| 7,684,982 | B2 * | 3/2010 | Taneda | 704/233 |
| 2002/0152066 | A1 | 10/2002 | Piket | |
| 2002/0188445 | A1 * | 12/2002 | Li | 704/233 |
| 2003/0179888 | A1 | 9/2003 | Burnett et al. | |
| 2004/0236571 | A1 | 11/2004 | Laurila et al. | |
| 2005/0143989 | A1 * | 6/2005 | Jelinek | 704/226 |
| 2005/0182620 | A1 * | 8/2005 | Kabi et al. | 704/216 |
| 2005/0222842 | A1 * | 10/2005 | Zakarauskas | 704/233 |
| 2006/0116873 | A1 * | 6/2006 | Hetherington et al. | 704/226 |
| 2006/0217976 | A1 | 9/2006 | Gao et al. | |

FOREIGN PATENT DOCUMENTS

| | | | |
|---|---|---|---|
| CN | 1242553 | A | 1/2000 |
| CN | 1293428 | A | 5/2001 |
| CN | 1354870 | A | 6/2002 |
| CN | 1703736 | A | 11/2005 |
| CN | 1773605 | A | 5/2006 |
| JP | 11-327582 | A | 11/1999 |
| JP | 2002-535708 | A | 10/2002 |
| JP | 2002-366174 | A | 12/2002 |
| JP | 2002-542692 | A | 12/2002 |
| JP | 2003-524794 | A | 8/2003 |
| JP | 2005-503579 | A | 2/2005 |
| JP | 2006-502426 | A | 1/2006 |
| JP | 2006-502427 | A | 1/2006 |

OTHER PUBLICATIONS

First Office Action in Chinese Application No. 200710108408.0, mailed Jun. 13, 2010.

(Continued)

*Primary Examiner* — Michael N Opsasnick
(74) *Attorney, Agent, or Firm* — Leydig, Voit & Mayer, Ltd.

(57) ABSTRACT

A voice activity detection (VAD) device and method provide for a VAD threshold that is adaptive to background noise variation.

17 Claims, 2 Drawing Sheets

OTHER PUBLICATIONS

Written Opinion in PCT Application No. PCT/CN2008/070899, mailed Aug. 21, 2008.
Office Action in corresponding Korean Application No. 10-2009-7026440 (Sep. 5, 2011).
Rejection Decision in corresponding Japanese Application No. 2010-510638 (Jan. 3, 2012).
Extended European Search Report in corresponding European Application No. 08734254.9 (Aug. 2, 2010).

* cited by examiner

VOICE ACTIVITY DETECTION

CROSS-REFERENCE TO RELATED APPLICATIONS

This application is a continuation of International Patent Application No. PCT/CN2008/070899, filed May 7, 2008, which claims priority to Chinese Patent Application No. 200710108408.0, filed Jun. 7, 2007, both of which are hereby incorporated by reference in their entireties.

FIELD OF THE INVENTION

The present invention relates generally to a audio signal processing, and more particularly to a voice activity detection device and method.

BACKGROUND OF THE INVENTION

In the voice signal processing field, a technology for detecting the voice activity has been widely used. This technology is called voice activity detection (VAD) in the voice coding field; it is called speech endpoint detection in the speech recognition field; it is called speech pause detection in the speech enhancement field. These technologies focus on different aspects in different scenarios, and thus achieve different processing results. In essence, however, these technologies are used to detect whether a speech exists in the case of voice communications or in a corpus. The detection accuracy has direct influences on the quality of subsequent processes (for example, voice coding, speech recognition and enhancement).

The voice coding technology can reduce the transmission bandwidth of voice signals and increase the capacity of a communication system. In a voice communication, 40% of the time involves voice signals, and the rest involves silence or background noises. Thus, to save transmission bandwidth, VAD may be used to differentiate background noises and non-noise signals, so that the encoder can encode the background noises and non-noise signals with different rates, thus reducing the mean bit rate. In recent years, all the voice coding standards formulated by large organizations and institutions cover specific applications of the VAD technology.

In the conventional art, the VAD algorithms such as VAD1 and VAD2 used in the adaptive multi-rate speech codec (AMR) judge whether a current signal frame is a noise frame according to the signal noise ratio (SNR) of an input signal. VAD calculates estimated background noise energy, and compares the ratio of the energy of the current signal frame to the energy of the background noise (that is, the SNR) with a preset threshold. When the SNR is greater than the threshold, VAD determines that the current signal frame is a non-noise frame; otherwise, VAD determines that the current signal frame is a noise frame. The VAD classification result is used to guide discontinuous transmission system/comfortable noise generation (DTX/CNG) in the encoder. The purpose of DTX/CNG is to perform discontinuous coding and transmission on only noise sequences when the input signal is in the noise period. The noises that are not coded and transmitted are interpolated at the decoder, so as to save bandwidth.

During the implementation of the present invention, the inventor finds the following problem in the conventional art: The VAD algorithm in the conventional art is adaptive according to the moving average of a long-term background noise level, and is not adaptive to the background noise variation. Thus, the adaptability is limited.

SUMMARY OF THE INVENTION

Embodiments of the present invention provide a VAD device and method, so that the VAD threshold can be adaptive to the background noise variation.

A VAD device provided in an embodiment of the present invention includes: (1) a background analyzing unit, adapted to: analyze background noise features of a current signal according to an input VAD judgment result, obtain parameters related to a background noise variation, and output the obtained parameters; (2) a VAD threshold adjusting unit, adapted to: obtain a bias of a VAD threshold according to the parameters output by the background analyzing unit, and output the bias of the VAD threshold; and (3) a VAD judging unit, adapted to: modify a VAD threshold to be modified according to the bias of the VAD threshold output by the VAD threshold adjusting unit, perform a background noise judgment by using the modified VAD threshold, and output a VAD judgment result.

A VAD method provided in an embodiment of the present invention includes: (1) analyzing background noise features of a current signal according to the VAD judgment result of a background noise, and obtaining parameters related to a background noise variation; (2) obtaining a bias of a VAD threshold according to the parameters related to the background noise variation; and (3) modifying a VAD threshold to be modified according to the bias of the VAD threshold, and performing VAD judgment on the background noise by using the modified VAD threshold.

DETAILED DESCRIPTION OF THE INVENTION

The following describes a VAD algorithm in a scenario in an embodiment of the present invention.

In this algorithm, the input signal frame is divided into nine subbands. The signal level level[n] and estimated background noise level bckr_est[n] of each subband are calculated. Then, the SNR is calculated by the following formula according to level[n] and bckr_est[n]:

$$snr = \sum_{n=1}^{9} \mathrm{MAX}\left(1.0, \frac{\mathrm{level}[n]}{\mathrm{bckr_est}[n]}\right)^2$$

The VAD judgment is to compare the SNR with a threshold vad_thr. If the SNR is greater than vad_thr, the current frame is a non-noise frame; otherwise, the current frame is a noise frame. vad_thr is calculated by the following formula:

$$vad_thr = VAD_SLOPE * noise_level + VAD_THR_HIGH$$

where $$noise_level = \sum_{n=1}^{9} bckr_est[n],$$

$$VAD_SLOPE = -540/6300,$$

and $$VAD_THR_HIGH = 1260.$$

In this VAD algorithm, only noise_level is the dependent variable of vad_thr, but noise_level reflects the moving average of a long-term background noise level. Thus, vad_thr is not adaptive to the background noise variation (because a background with different variations may have the same moving average of the long-term level). In addition, the background variation has a great impact on the VAD judgment. For example, VAD may wrongly determine that a large number of background noises are non-noise signals, thus wasting bandwidth.

Figure 1:
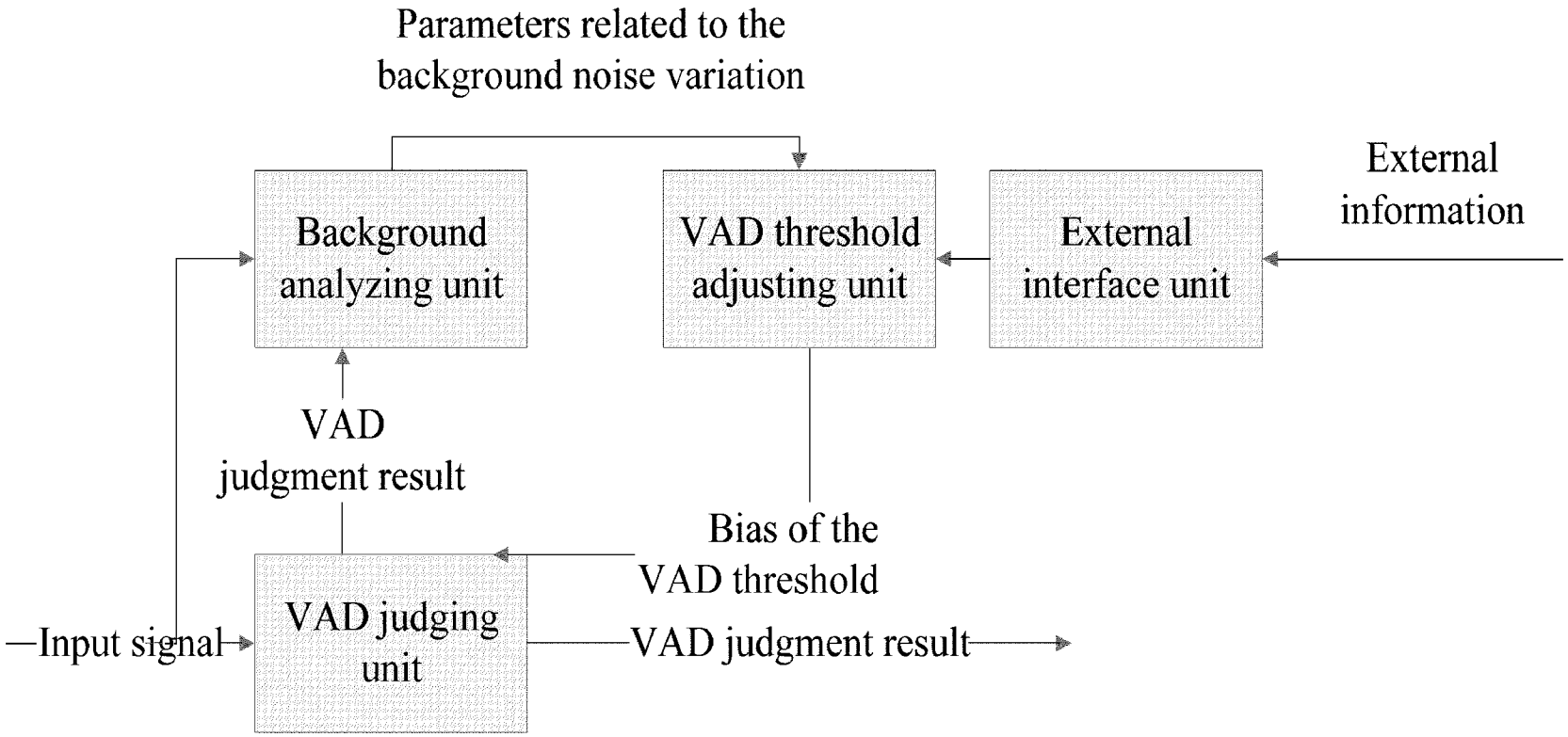
FIG. 1 shows a structure of a VAD device in an embodiment of the present invention.

First embodiment: FIG. 1 illustrates a VAD device in the first embodiment of the present invention. The VAD device includes a background analyzing unit, a VAD threshold adjusting unit, a VAD judging unit, and an external interface unit.

The background analyzing unit is adapted to: analyze the background noise features of the current signal according to the input VAD judgment result, obtain parameters related to a background noise variation, and output these parameters to the VAD threshold adjusting unit, where these parameters include parameters of the background noise variation. Specifically, the background noise feature parameters are used to identify the size, type (steady background or unsteady background), variation rate and SNR of the background noise of the current signal in the current environment. The background noise feature parameters include at least peak SNR of the background noise, and may further include long-term SNR, estimated background noise level, background noise energy variation, background noise spectrum variation, and background noise variation rate.

The VAD threshold adjusting unit is adapted to: obtain a bias of the VAD threshold according to the parameters output by the background analyzing unit, and output the bias of the VAD threshold.

Specifically, when the VAD threshold adjusting unit receives any one of the parameters output by the background analyzing unit, the VAD threshold adjusting unit updates the bias of the VAD threshold according to the current values of the parameters related to the background noise variation. The VAD threshold adjusting unit may further judge whether the parameter values output by the background analyzing unit are changed; if so, the VAD threshold adjusting unit updates the bias of the VAD threshold according to the current values of the parameters related to the background noise variation.

The bias of the VAD threshold is obtained through internal adaptation of the VAD threshold adjusting unit according to the parameters output by the background analyzing unit, and/or by combining the external work point information of the VAD device (received through the external interface unit) and the parameters output by the background analyzing unit.

When the setting considers only the internal adaptation of the VAD threshold adjusting unit, the VAD threshold adjusting unit obtains a first bias of the VAD threshold according to the parameters output by the background analyzing unit, and outputs the first bias of the VAD threshold as a final bias of the VAD threshold to the VAD judging unit.

When the setting considers the external information of the VAD device and the internal adaptation of the VAD threshold adjusting unit and the background noise of the current signal is a steady noise and/or the SNR of the current signal is high, the VAD judgment result of the VAD judging unit is closer to the ideal result, making it unnecessary to calculate a second bias of the VAD threshold according to the external information. Thus, the VAD threshold adjusting unit obtains the first bias of the VAD threshold according to the parameters output by the background analyzing unit, and outputs the first bias of the VAD threshold as a final bias of the VAD threshold to the VAD judging unit.

When the setting considers the external information of the VAD device and the internal adaptation of the VAD threshold adjusting unit and the background noise of the current signal is a non-steady noise and/or the SNR of the current signal is low, the VAD threshold adjusting unit obtains a first bias of the VAD threshold according to the parameters output by the background analyzing unit and a second bias of the VAD threshold according to the parameters output by the background analyzing unit and the external information of the VAD device, obtains a final bias of the VAD threshold by combining the first bias of the VAD threshold and the second bias of the VAD threshold (for example, adding up these two thresholds or processing these two thresholds in other ways), and outputs the final bias of the VAD threshold to the VAD judging unit.

When the setting considers only the external information of the VAD device, the VAD threshold adjusting unit obtains a second bias of the VAD threshold according to the parameters output by the background analyzing unit and the external information of the VAD device, and outputs the second bias of the VAD threshold as a final bias of the VAD threshold to the VAD judging unit.

The VAD judging unit is adapted to: modify a VAD threshold to be modified according to the bias of the VAD threshold output by the VAD threshold adjusting unit, judge the background noise by using the modified VAD threshold, and output the VAD judgment result to the background analyzing unit so as to implement constant adaptation of the VAD threshold. In addition, the VAD judging unit is adapted to output the VAD judgment result.

In the VAD algorithm in another scenario in the first embodiment, the method for determining a VAD threshold to be modified has the following relationship with the SNR: In the method for calculating a threshold to be modified in AMR VAD2, multiple thresholds to be modified are pre-stored in an array. These thresholds have certain mapping relationships with the long-term SNR. VAD selects a threshold to be modified in the array according to the current long-term SNR, and uses the selected threshold as the VAD threshold to be modified. The method for determining a VAD threshold to be modified in this embodiment may include: using the long-term SNR of the current signal as the threshold to be modified. For example, supposing the final VAD threshold is 100, and the bias of the VAD threshold output by the VAD threshold adjusting unit is 10, and the current VAD threshold to be modified is 95, the modified final VAD threshold is 105. Then, the VAD judging unit changes the VAD threshold from 100 to 105, and continues the judgment.

Specifically, VAD in this embodiment includes VAD for differentiating the background noise and non-background noise and new VAD in SAD for differentiating the background noise, voice, and music. For VAD, the classified type includes background noise and non noise. For SAD, the classified type includes background noise, voice, and music. In this embodiment, the VAD in SAD categorizes the input signal into background noise and non noise. That is, it processes the voice and music as the same type.

Figure 2:
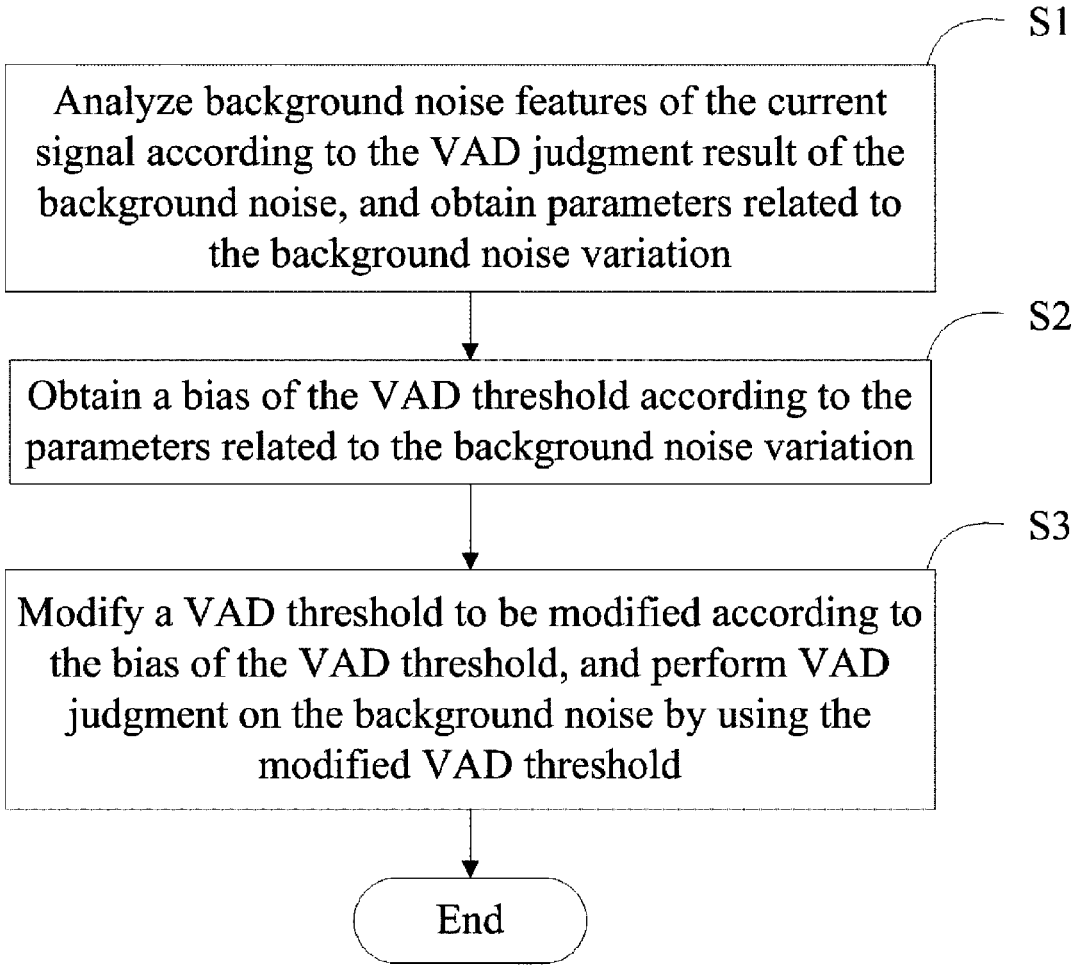
FIG. 2 is a flowchart of a VAD method in an embodiment of the present invention.

Second embodiment: FIG. 2 shows a VAD method in the second embodiment of the present invention. The VAD method includes the following steps:

S1. Analyze background noise features of the current signal according to the VAD judgment result of the background noise, and obtain parameters related to the background noise variation.

The parameters related to the background noise variation include at least peak SNR of the background noise, and may further include a background energy variation size, a background noise spectrum variation size, and/or a background noise variation rate. In the process of obtaining the parameters related to the background noise variation, other parameters that represent the background noise features of the current signal are also obtained, for example, the long-term SNR and estimated background noise level.

S2. Obtain a bias of the VAD threshold according to the parameters related to the background noise variation.

When any one of the parameters related to the background noise variation is updated, the bias of the VAD threshold is updated according to the current values of the parameters related to the background noise variation.

Specifically, the method for obtaining a bias of the VAD threshold according to the current values of the parameters related to the background noise variation includes but is not limited to the following four cases:

Case 1: When the setting does not need to consider the specified information, a first bias of the VAD threshold is obtained according to the parameters related to the background noise variation, and the first bias of the VAD threshold is used as a final bias of the VAD threshold.

Case 2: When the setting needs to consider the specified information and the background sound is an unsteady noise and/or the SNR is low, a first bias of the VAD threshold is obtained according to the parameters related to the background noise variation and a second bias of the VAD threshold is obtained according to the parameters related to the background noise variation and the specified information; a final bias of the VAD threshold is obtained by combining the first bias of the VAD threshold and the second bias of the VAD threshold (for example, adding up these two thresholds or processing these two thresholds in other ways).

Case 3: When the setting needs to consider the specified information and the background sound is a steady noise and/or the SNR is high, a first bias of the VAD threshold is obtained according to the parameters related to the background noise variation, and the first bias of the VAD threshold is used as a final bias of the VAD threshold.

Case 4: When the setting considers the specified information only, a second bias of the VAD threshold is obtained according to the parameters related to the background noise variation and the specified information, and the second bias of the VAD threshold is used as a final bias of the VAD threshold.

In the preceding cases 1 to 3, the first bias of the VAD threshold increases with the increase of the background noise energy variation, background noise spectrum variation size, background noise variation rate, long-term SNR, and/or peak SNR of the background noise. The first bias of the VAD threshold may be calculated by one of the following formulas:

vad_thr_delta=β*(snr_peak-vad_thr_default), where vad_thr_delta indicates the first bias of the VAD threshold; vad_thr_default indicates the VAD threshold to be modified; snr_peak indicates the peak SNR of the background noise; and β is a constant.

vad_thr_delta=β*f(var_rate)*(snr_peak-vad_thr_default), where vad_thr_delta indicates the first bias of the VAD threshold; vad_thr_default indicates the VAD threshold to be modified; snr_peak indicates the peak SNR of the background noise; β is a constant; var_rate indicates the background noise variation rate; and f( ) indicates a function.

vad_thr_delta=β*f(var_rate)*f(pow_var)*(snr_peak-vad_thr_default), where vad_thr_delta indicates the first bias of the VAD threshold; vad_thr_default indicates the VAD threshold to be modified; snr_peak indicates the peak SNR of the background noise; β is a constant; pow_var indicates the background energy variation size; var_rate indicates the background noise variation rate; and f( ) indicates a function.

vad_thr_delta=β*f(var_rate)*f(spec_var)*(snr_peak-vad_thr_default), where vad_thr_delta indicates the first bias of the VAD threshold; vad_thr_default indicates the VAD threshold to be modified; snr_peak indicates the peak SNR of the background noise; β is a constant; spec_var indicates the background noise spectrum variation size; var_rate indicates the background noise variation rate; and f( ) indicates a function.

vad_thr_delta=β*f (var_rate)*f (pow_var)*f (spec_var)*(snr_peak-vad_thr_default), where vad_thr_delta indicates the first bias of the VAD threshold; vad_thr_default indicates the VAD threshold to be modified; snr_peak indicates the peak SNR of the background noise; β is a constant; spec_var indicates the background noise spectrum variation size; var_rate indicates the background noise variation rate; pow_var indicates the background energy variation size; and f( ) indicates a function.

Note: A long-term SNR parameter may be added to each of the preceding formulas for calculating the first bias of the VAD threshold. That is, the preceding formulas may also be applicable after a long-term SRN function is multiplied.

In the preceding cases 2 and 4, the absolute value of the second bias of the VAD threshold increases with the increase of the background noise energy variation, background noise spectrum variation size, background noise variation rate, long-term SNR, and/or peak SNR of the background noise. In addition, the specified information indicates a work point orientation and is represented by a positive or negative sign in the formulas. When the specified work point is a quality orientation, the sign is negative; when the specified work point is a bandwidth-saving orientation, the sign is positive. The second bias of the VAD threshold may be calculated by one of the following formulas:

vad_thr_delta_out=sign*γ*(snr_peak-vad_thr_default), where vad_thr_delta_out indicates the second bias of the VAD threshold; vad_thr_default indicates the VAD threshold to be modified; sign indicates the positive or negative sign of vad_thr_delta_out determined by the orientation of the specified information; snr_peak indicates the peak SNR of the background noise; and γ is a constant.

vad_thr_delta_out=sign*γ*f (var_rate)*(snr_peak-vad_thr_default), where vad_thr_delta_out indicates the second bias of the VAD threshold; vad_thr_default indicates the VAD threshold to be modified; sign indicates the positive or negative sign of vad_thr_delta out determined by the orientation of the specified information; snr_peak indicates the peak SNR of the background noise; γ is a constant; var_rate indicates the background noise variation rate; and f( ) indicates a function.

vad_thr_delta_out=sign*γ*f(var_rate)*f(pow_var)*(snr_peak-vad_thr_default), where vad_thr_delta_out indicates the second bias of the VAD threshold; vad_thr_default indicates the VAD threshold to be modified; sign indicates the positive or negative sign of vad_thr_delta_out determined by the orientation of the specified information; snr_peak indicates the peak SNR of the background noise; γ is a constant; pow_var indicates the background energy variation size; var_rate indicates the background noise variation rate; and f( ) indicates a function.

vad_thr_delta_out=sign*γ*f(var_rate)*f(pow_var)*(snr_peak-vad_thr_default), where vad_thr_delta_out indicates the second bias of the VAD threshold; vad_thr_default indicates the VAD threshold to be modified; sign indicates the positive or negative sign of vad_thr_delta_out determined by the orientation of the specified information; snr_peak indicates the peak SNR of the background noise; γ is a constant; spec_var indicates the background noise spectrum variation size; var_rate indicates the background noise variation rate; and f( ) indicates a function.

vad_thr_delta_out=sign*γ*f(var_rate)*f(pow_var)*f(spec_var)*(snr_peak-vad_thr_default), where vad_thr_delta_out indicates the second bias of the VAD threshold; vad_thr_default indicates the VAD threshold to be modified; sign indicates the positive or negative sign of vad_thr_delta_out determined by the orientation of the specified information; snr_peak indicates the peak SNR of the background noise; γ is a constant; spec_var indicates the background noise spectrum variation size; var_rate indicates the background noise variation rate; pow_var indicates the background energy variation size; and f( ) indicates a function.

Note: A long-term SNR parameter may be added to each of the preceding formulas for calculating the second bias of the VAD threshold. That is, the preceding formulas may also be applicable after a long-term SRN function is multiplied.

In the preceding formulas for calculating the first bias of the VAD threshold and the second bias of the VAD threshold, snr_peak is the largest SNR of the SNRs corresponding to each background noise frame between two adjacent non-background noise frames, or the smallest SNR of the SNRs corresponding to each non-background noise frame between two adjacent background noise frames, or any one of the SNRs corresponding to each non-background noise frame between two background noise frames with the interval smaller than a preset number of frames, or any one of the SNRs corresponding to each non-background noise frame that are smaller than a preset threshold between two background noise frames with the interval greater than a preset number of frames. The threshold is set according to the following rule: Suppose the SNRs of all the non-background noise frames between the two background noise frames comprise two sets: one is composed of all the SNRs greater than a threshold, and the other is composed of all the SNRs smaller than the threshold; a threshold that maximizes the difference between the mean values of these two sets is determined as the preset threshold.

S3. Modify a VAD threshold to be modified according to the bias of the VAD threshold, and perform VAD judgment on the background noise by using the modified VAD threshold.

Third embodiment: This embodiment provides a modular process by combining the VAD device and method provided in the preceding embodiments.

Step 1: The VAD judging unit performs initial judgment on the type of the input audio signal, and inputs the VAD judgment result to the background analyzing unit.

The initial bias of the VAD threshold is 0. The VAD judging unit performs VAD judgment according to the VAD threshold to be modified. For example, the VAD threshold to be modified is to secure a balance between the quality and the bandwidth saving.

Step 2: When the background analyzing unit knows that the current frame is a background noise frame according to the VAD judgment result, the background analyzing unit calculates the short-term background noise feature parameters of the current frame, and stores these parameters in the memory. The following describes these parameters and methods for calculating these parameters:

1. Subband level level [k, i], where k and i indicate the level of the $k^{th}$ subband of the $i^{th}$ frame. The subband may be calculated by using a filter group or a conversion method.

2. Short-term background noise level bckr_noise [i] (calculated only when the current frame is a background frame), $$\text{bckr_noise}[i] = \sum_{k=1}^{N} \text{level}[k, i],$$

where i indicates the background noise level of the $i^{th}$ frame; k indicates the $k^{th}$ subband; and N indicates the total number of subbands.

3. Frame energy pow [i], $$pow[i] = \sum_{k=1}^{N} \text{level}[k, i]^2,$$

where i indicates the frame energy of the $i^{th}$ frame.

4. Short-term SNR snr [i], $$snr[i] = \frac{pow[i]}{\text{bckr_noise_pow}[i]},$$

where i indicates the short-term SNR of the $i^{th}$ frame, and bckr_noise_pow [i] indicates the estimated background noise energy. These parameters will be described later.

Step 3: When the background analyzing unit has analyzed a certain number of frames, the background analyzing unit begins to calculate the long-term background noise feature parameters according to the history short-term background noise feature parameters in the memory, and outputs the parameters related to the background noise variation. Then, the parameters related to the background noise variation are updated continuously. Except the long-term SNR, other parameters are updated only when the current frame is a background frame. The long-term SNR is updated only when the current frame is a non-background noise. The following describes these parameters and methods for calculating these parameters:

1. Estimated long-term background noise level bckr_noise_long [i], bckr_noise_long[i]=(1−α)*bckr_noise_long[i−1]+α*bckr_noise[i], where α is a scale factor between 0 and 1 and its value is about 5%.

2. Long-term SNR snr_long[i], $$\text{snr_long}[i] = \frac{\sum_{m=i-L+1}^{i} snr[m]}{L},$$

where L indicates the number of non-background frames that are selected for long-term average calculation.

3. Background noise energy variation pow_var [i], $$\text{pow_var}[i] = \frac{1}{L} * \sum_{m=i-L+1}^{i} \left( pow[m] - \frac{1}{L} * \sum_{m=i-L+1}^{i} pow[m] \right)^2,$$

where L indicates the number of background frames that are selected for long-term average calculation.

4. Background noise spectrum variation spec_var [i], $$\text{spec_var}[i] = \sum_{m=i-L+1}^{i} \left( \sum_{n=i-L+1, n\neq m}^{i} \left( \sum_{k=1}^{N} (\text{level}[k, m] - \text{level}[k, n])^2 \right) \right),$$

where L indicates the number of background frames that are selected for long-term average calculation. The background noise spectrum variation may also be calculated based on the line spectrum frequency (LSF) coefficient.

5. Background noise variation rate var_rate[i], $$\text{var_rate} = \sum_{m=i-L+1}^{i} \amalg\{snr[i] < 0\},$$

where $\amalg\{x\}$ is equal to 1 when x is true; otherwise it is equal to 0; and L indicates the number of background frames that are selected for long-term average calculation.

6. Estimated long-term background noise energy bckr_noise_pow [i], bckr_noise_pow[i]=(1−α)*bckr_noise_pow[i−1]+α*pow[i], where α a is a scale factor between 0 and 1 and its value is about 5%.

Step 4: The VAD threshold adjusting unit calculates the bias of the VAD threshold according to the parameters that are related to the background noise variation and output by the background analyzing unit.

In the process of modifying the VAD threshold, a bias of the VAD threshold should be obtained so as to modify the VAD threshold in the corresponding direction at an amplitude.

According to the first case in step S2 in the second embodiment, the VAD threshold adjusting unit obtains the first bias of the VAD threshold through the internal adaptation, and uses the first bias of the VAD threshold as the final bias of the VAD threshold, without considering the externally specified information. Supposing the current VAD threshold to be modified is vad_thr_default and the first bias of the VAD threshold is vad_thr_delta, the modified VAD threshold is vad_thr_default+vad_thr_delta. Then, the first bias of the VAD threshold is calculated by the following formula: vad_thr_delta=β*(snr_peak-vad_thr_default), where snr_peak indicates the background peak SRN and β is a constant. snr_peak may be a peak SNR in a long-term history background frame section; that is, snr_peak=MAX(snr[i]), i=0, −1, −2 . . . −n, where i indicates the latest history background frame and the first background frame to the $n^{th}$ background frame before the latest history background frame. snr_peak may also be a valley SNR in a history non-background frame section or one of multiple smallest SNRs. In this case, snr_peak=MIN (snr [i]), i=0, −1, −2 . . . −n, where i indicates the latest history non-background frame and the first non-background frame to the $n^{th}$ non-background frame before the latest history non-background frame, or snr_peak∈{X}, where {X} indicates a subset of a set of SNRs ({Y}) in a long-term history non-background frame section, and maximizes the value of |MEAN({X})−MEAN({Y−X})|, where MEAN indicates the mean value. var_rate indicates the times of negative SNRs in a long-term background.

That is, snr_peak is the largest SNR of the SNRs corresponding to each background noise frame between two adjacent non-background noise frames, or the smallest SNR of the SNRs corresponding to each non-background noise frame between two adjacent background noise frames, or any one of the SNRs corresponding to each non-background noise frame between two background noise frames with the interval smaller than a preset number of frames, or any one of the SNRs corresponding to each non-background noise frame that are smaller than a preset threshold between two background noise frames with the interval greater than a preset number of frames. The threshold is set according to the following rule: Suppose the SNRs of all the non-background noise frames between the two background noise frames comprise two sets: one is composed of all the SNRs greater than a threshold, and the other is composed of all the SNRs smaller than the threshold; a threshold that maximizes the difference between the mean values of these two sets is determined as the preset threshold.

In a VAD algorithm with multiple thresholds, each threshold or several of these thresholds may be adjusted according to the preceding method.

Step 5: The VAD judging unit modifies a VAD threshold to be modified according to the bias of the VAD threshold output by the VAD threshold adjusting unit, judges the background noise according to the modified VAD threshold, and outputs the VAD judgment result.

If the VAD threshold adjusting unit obtains the bias of the VAD threshold according to the first case, the modified VAD threshold is vad_thr_default+vad_thr_delta.

In conclusion, in embodiments of the present invention, the background noise features of the current signal are analyzed according to the VAD judgment result of the background noise, and the parameters related to the background noise variation are obtained, making the VAD threshold adaptive to the background noise variation. Then, the bias of the VAD threshold is obtained according to the parameters related to the background noise variation; the VAD threshold to be modified is modified according to the bias of the VAD threshold, and a VAD threshold that can reflect the background noise variation is obtained; and the VAD judgment is performed on the background noise by using the modified VAD threshold. Thus, the VAD threshold is adaptive to the background noise variation, so that VAD can achieve an optimum performance in a background noise environment with different variations.

Further, embodiments of the present invention provide different implementation modes according to the methods for obtaining the bias of the VAD threshold. In particular, embodiments of the present invention describe the solution for calculating the value of the peak SNR of the background noise (snr_peak), which better supports the present invention.

It is understandable to those skilled in the art that all or part of the steps in the methods according to the preceding embodiments may be performed by hardware instructed by a program. The program may be stored in a computer readable storage medium, such as a Read-Only Memory/Random Access Memory (ROM/RAM), a magnetic disk, and a compact disk.

It is apparent that those skilled in the art can make various changes and modifications to the present invention without departing from the spirit and scope of the present invention. The present invention is intended to cover such changes and modifications provided that they fall in the scope of protection defined by the following claims or their equivalents.

What is claimed is:

1. A voice activity detection (VAD) device, comprising:

a background analyzing unit adapted to analyze background noise features of a current signal according to an input VAD judgment result, obtain parameters related to a background noise variation, and output the obtained parameters;

a VAD threshold adjusting unit adapted to obtain a bias of the VAD threshold according to the parameters output by the background analyzing unit, and output the bias of the VAD threshold; and a VAD judging unit adapted to modify a VAD threshold to be modified according to the bias of the VAD threshold output by the VAD threshold adjusting unit, perform a background noise judgment according to the modified VAD threshold, and output a VAD judgment result;

wherein the device further comprising an external interface unit adapted to receive external information of the device;

wherein the VAD threshold adjusting unit obtains a first bias of the VAD threshold according to the parameters output by the background analyzing unit, and outputs the first bias of the VAD threshold as a final bias of the VAD threshold to the VAD judging unit; or the VAD threshold adjusting unit obtains a first bias of the VAD threshold according to the parameters output by the background analyzing unit and a second bias of the VAD threshold according to the parameters output by the background analyzing unit and the external information of the device, obtains a final bias of the VAD threshold by combining the first bias of the VAD threshold and the second bias of the VAD threshold, and outputs the final bias of the VAD threshold to the VAD judging unit; or the VAD threshold adjusting unit obtains a second bias of the VAD threshold according to the parameters output by the background analyzing unit and the external information of the device, and outputs the second bias of the VAD threshold as a final bias of the VAD threshold to the VAD judging unit.

2. The VAD device of claim 1, wherein the parameters output by the background analyzing unit comprise a peak signal noise ratio (SNR) of the background noise.

3. The VAD device of claim 2, wherein the parameters output by the background analyzing unit further comprise at least one of a background energy variation size, a background noise spectrum variation size, a long-term SNR, and a background noise variation rate.

4. The VAD device of claim 1, wherein, when the VAD threshold adjusting unit receives any one of the parameters output by the background analyzing unit, the VAD threshold adjusting unit adapted to update the bias of the VAD threshold according to current values of the parameters related to the background noise variation.

5. The VAD device of claim 1, wherein the VAD judging unit updates the VAD threshold to be modified on a real-time basis, extracts a current VAD threshold to be modified when receiving a bias of the VAD threshold output by the VAD threshold adjusting unit, and modifies the current VAD threshold according to the bias of the VAD threshold.

6. A voice activity detection (VAD) method, comprising:

analyzing background noise features of a current signal according to a VAD judgment result of a background noise, and obtaining parameters related to a background noise variation;

obtaining a bias of the VAD threshold according to the parameters related to the background noise variation; and modifying a VAD threshold to be modified according to the bias of the VAD threshold, and performing VAD judgment on the background noise by using the modified VAD threshold;

wherein the method for obtaining a bias of the VAD threshold according to the parameters related to the background noise variation comprises at least one of following blocks:

when the setting does not need to consider specified information obtaining a first bias of the VAD threshold according to the parameters related to the background noise variation and using the first bias of the VAD threshold as a final bias of the VAD threshold;

when the setting needs to consider specified information and the background sound is an unsteady noise and/or a signal noise ratio (SNR) is low obtaining a first bias of the VAD threshold according to the parameters related to the background noise variation and a second bias of the VAD threshold according to the parameters related to the background noise variation and the specified information, and obtaining a final bias of the VAD threshold by combining the first bias of the VAD threshold and the second bias of the VAD threshold;

when the setting needs to consider specified information and the background sound is a steady noise and/or the SNR is high obtaining a first bias of the VAD threshold according to the parameters related to the background noise variation and using the first bias of the VAD threshold as a final bias of the VAD threshold; and when the setting considers specified information only, obtaining a second bias of the VAD threshold according to the parameters related to the background noise variation and the specified information and using the second bias of the VAD threshold as a final bias of the VAD threshold.

7. The VAD method of claim 6, wherein the parameters related to the background noise variation comprise a peak signal noise ratio (SNR) of the background noise.

8. The VAD method of claim 7, wherein the parameters related to the background noise variation further comprise at least one of a background energy variation size, a background noise spectrum variation size, a long-term SNR, and a background noise variation rate.

9. The VAD method of claim 6, wherein, when any of the parameters related to the background noise variation is updated, the method comprises: updating the bias of the VAD threshold according to current values of the parameters related to the background noise variation.

10. The VAD method of claim 6, wherein the first bias of the VAD threshold increases with at least one of the increase of the background noise energy variation, background noise spectrum variation size, background noise variation rate, long-term SNR, and peak SNR of the background noise.

11. The VAD method of claim 10, further comprises at least one of following:

vad_thr_delta=β*(snr_peak-vad_thr_default);

vad_thr_delta=β*f(var_rate)*(snr_peak-vad_thr_default);

vad_thr_delta=β*f(var_rate)*f(pow_var)*(snr_peak-vad_thr_default);

vad_thr_delta=β*f(var_rate)*f(spec_var)*(snr_peak-vad_thr_default); and vad_thr_delta=β*f(var_rate)*f(pow_var)*f(spec_var)*(snr_peak-vad_thr_default), wherein vad_thr_delta indicates the first bias of the VAD threshold; vad_thr_default indicates the VAD threshold to be modified; snr_peak indicates the peak SNR of the background noise; β is a constant; var_rate indicates the background noise variation rate; f( )indicates a function; pow_var indicates the background energy variation size; and spec_var indicates the background noise spectrum variation size.

12. The VAD method of claim 6, wherein an absolute value of the second bias of the VAD threshold increases with at least one of the increase of the background noise energy variation, background noise spectrum variation size, background noise variation rate, long-term SNR, and peak SNR of the background noise.

13. The VAD method of claim 12, further comprises at least one of following:

vad_thr_delta_out=sign*γ*(snr_peak-vad_thr_default);

vad_thr_delta_out=sign*γ*f(var_rate)*(snr_peak-vad_thr_default);

vad_thr_delta_out=sign*γ*f(var_rate)*f(pow_var)*(snr_peak-vad_thr_default);

vad_thr_delta_out=sign*γ*f(var_rate)*f(spec_var)*(snr_peak-vad_thr_default); and vad_thr_delta_out=sign*γ*f(var_rate)*f(pow_var)*f(spec_var)*(snr_peak-vad_thr_default), wherein vad_thr_delta_out indicates the second bias of the VAD threshold; vad_thr_default indicates the VAD threshold to be modified; sign indicates a positive or negative sign of vad_thr_delta_out determined by an orientation of the specified information; snr_peak indicates the peak SNR of the background noise; γ is a constant; var_rate indicates the background noise variation rate; f( )indicates a function; pow_var indicates the background energy variation size; spec_var indicates the background noise spectrum variation size.

14. The method of claim 11, wherein snr_peak is a largest SNR of SNRs corresponding to each background noise frame between two adjacent non-background noise frames; or snr_peak is a smallest SNR of SNRs corresponding to each non-background noise frame between two adjacent background noise frames; or snr_peak is any one of SNRs corresponding to each non-background noise frame between two background noise frames with an interval smaller than a preset number of frames; or snr_peak is any one of SNRs corresponding to non-background noise frames that are smaller than a preset threshold between two background noise frames with an interval greater than a preset number of frames.

15. The method of claim 13, wherein snr_peak is a largest SNR of SNRs corresponding to each background noise frame between two adjacent non-background noise frames; or snr_peak is a smallest SNR of SNRs corresponding to each non-background noise frame between two adjacent background noise frames; or snr_peak is any one of SNRs corresponding to each non-background noise frame between two background noise frames with an interval smaller than a preset number of frames; or snr_peak is any one of SNRs corresponding to non-background noise frames that are smaller than a preset threshold between two background noise frames with an interval greater than a preset number of frames.

16. The method of claim 14, wherein if snr_peak is any one of SNRs corresponding to non-background noise frames that are smaller than a preset threshold between two background noise frames with an interval greater than a preset number of frames, the threshold is set according to the rule of: supposing all the SNRs of the non-background noise frames between the two background noise frames comprise two sets, wherein one set is composed of all the SNRs larger than a threshold and the other is composed of all the SNRs smaller than the threshold, a threshold that maximizes the difference between mean values of each set is determined as the preset threshold.

17. The method of claim 15, wherein if snr_peak is any one of SNRs corresponding to non-background noise frames that are smaller than a preset threshold between two background noise frames with an interval greater than a preset number of frames, the threshold is set according to the rule of: supposing all the SNRs of the non-background noise frames between the two background noise frames comprise two sets, wherein one set is composed of all the SNRs larger than a threshold and the other is composed of all the SNRs smaller than the threshold, a threshold that maximizes the difference between mean values of each set is determined as the preset threshold.

* * * * *

UNITED STATES PATENT AND TRADEMARK OFFICE

CERTIFICATE OF CORRECTION

PATENT NO. : 8,275,609 B2
APPLICATION NO. : 12/630963
DATED : September 25, 2012
INVENTOR(S) : Zhe Wang It is certified that error appears in the above-identified patent and that said Letters Patent is hereby corrected as shown below:

In column 12, line 19, “mation obtaining” should read --mation, obtaining--.
In column 12, line 21, “variation and” should read --variation, and--.
In column 12, line 25, “low obtaining” should read --low, obtaining--.
In column 12, line 35, “high obtaining” should read --high, obtaining--.
In column 12, line 37, “variation and” should read --variation, and--.
In column 12, line 42, “information and” should read --information, and--.

Signed and Sealed this
Twenty-seventh Day of November, 2012

David J. Kappos

David J. Kappos
*Director of the United States Patent and Trademark Office*